US009132437B2

(12) United States Patent
Zhou et al.

(10) Patent No.: US 9,132,437 B2
(45) Date of Patent: Sep. 15, 2015

(54) FOLDING CLAMSHELL SHOWER

(75) Inventors: Huasong Zhou, Xiamen (CN); Xiaozhao Sun, Xiamen (CN); Jianmin Chen, Xiamen (CN); Bin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 315 days.

(21) Appl. No.: 13/521,399

(22) PCT Filed: Jan. 21, 2011

(86) PCT No.: PCT/CN2011/070490

§ 371 (c)(1),
(2), (4) Date: Jul. 10, 2012

(87) PCT Pub. No.: WO2011/091737

PCT Pub. Date: Aug. 4, 2011

(65) Prior Publication Data

US 2012/0286073 A1 Nov. 15, 2012

(30) Foreign Application Priority Data

Jan. 27, 2010 (CN) ..... 2010 1 0113230
Jan. 27, 2010 (CN) ..... 2010 2 0123090 U

(51) Int. Cl.

| | |
|---|---|
| ***B05B 1/18*** | (2006.01) |
| ***B05B 1/16*** | (2006.01) |
| ***B05B 15/06*** | (2006.01) |
| ***E03C 1/04*** | (2006.01) |

(52) U.S. Cl.

CPC ..... *B05B 1/18* (2013.01); *B05B 1/1645* (2013.01); *B05B 15/066* (2013.01); *E03C 1/0405* (2013.01); *E03C 1/0409* (2013.01)

(58) Field of Classification Search

USPC ..... 239/587.1

See application file for complete search history.

(56) References Cited

U.S. PATENT DOCUMENTS

| | | | | |
|---|---|---|---|---|
| 4,557,003 | A * | 12/1985 | Jones | 4/605 |
| 6,151,931 | A | 11/2000 | Doelle | |
| 2006/0208111 | A1 * | 9/2006 | Tracy et al. | 239/587.2 |
| 2007/0272770 | A1 * | 11/2007 | Leber et al. | 239/451 |

FOREIGN PATENT DOCUMENTS

| | | | |
|---|---|---|---|
| CN | 2168529 | Y | 6/1994 |
| CN | 101069877 | A | 11/2007 |
| CN | 201040267 | Y | 3/2008 |
| CN | 201208583 | Y | 3/2009 |
| CN | 201596578 | U | 10/2010 |
| CN | 101879483 | A | 11/2010 |

* cited by examiner

*Primary Examiner* — Len Tran
*Assistant Examiner* — Adam J Rogers
(74) *Attorney, Agent, or Firm* — Rabin & Berdo, P.C.

(57) ABSTRACT

A folding clamshell shower has a body containing a water passage, a water diversion unit and an outlet unit. The outlet unit is rotationally and pivotally connected with the body to form the folding clamshell structure. The outlet unit is provided with at least two outlet functions; the water diversion unit is mounted at the rotary pivot joint site of the outlet unit and the body, and comprises a water diversion body; the rotation of the water diversion body relative to the body can be driven by the rotation between the outlet unit and the body, the relative rotation between the water diversion body and the body controls outlet functions of the shower to pause or switch.

24 Claims, 18 Drawing Sheets

FOLDING CLAMSHELL SHOWER

FIELD OF THE INVENTION

The present invention relates to a shower, and more particular to a folding clamshell shower.

BACKGROUND OF THE INVENTION

The switching of the outlet functions in the shower at the prior art is mainly achieved by rotating the outlet body to alternatively open or pause the corresponding water passage. Take an example, the utility mode patent with the name "the multi-function outlet structure of shower" and the patent application number CN200720006856.5 (equivalent to US 2011/0139886 A1, where the latter is incorporated by reference herein) uses the relative rotation of the outlet device and the inlet device to achieve the switching of the outlet functions through different outlet cavities communicating with different inlet opening respectively. This kind of switching method is increasingly common, and it makes the users feel boring during the using process, so the users cannot experience the fun of shower, and more designs are needed to satisfy the demands of different users.

SUMMARY OF THE INVENTION

The object of the present invention is to offer a folding clamshell shower, which overcomes the dull using way of the shower at the prior art.

One of the technical proposals to solve the technical matters in the present invention is:

Folding clamshell shower, it comprises a body containing water passage, a water diversion unit and a outlet unit, the outlet unit is rotationally and pivotally connected with the body to form the folding clamshell structure; the outlet unit is provided with at least two outlet functions; the water diversion unit is mounted at the rotary pivot joint site of the outlet unit and the body, and comprises a water diversion body; the rotation of the water diversion body relative to the body can be driven by the rotation between the outlet unit and the body, the relative rotation between the water diversion body and the body controls outlet functions of the shower to pause or switch.

In a preferred embodiment, it also comprises the first and the second pivot joint part which are sleeved to each other, the first pivot joint part is fixedly connected to the side of the outlet unit, and a groove containing the water diversion body is opened in the first pivot joint part; the second pivot joint part is fixedly connected to the side of the body with a passage cavity always communicating with the water passage, the outlet of the passage cavity is at the end face of the second pivot joint part, and the end face of the water diversion body is against the end face of the second pivot joint part.

In a preferred embodiment, the water diversion body is a podetium mounted in the water diversion unit with two end face, the first and the second inlet openings communicating with the first and the second outlet functions respectively are arranged on the first end face, and the second inlet opening runs through the podetium to the second end face, a curved slot communicating with the first inlet opening is opened on the side of the podetium.

In a preferred embodiment, it also comprises a plastic cup arranged at the outlet of the second pivot joint part.

In a preferred embodiment, the outlet unit comprises two outlet functions, and three positional relations that can be located are present between the outlet unit and the body, when the first position is present, the outlet unit covers the body, and the outlet is staggered away from the two inlet opening on the first end face of the water diversion body; the second and the third position are the two default pivotal angles respectively, the outlet is aligned to the first and the second inlet opening on the first end face of the water diversion body respectively.

In a preferred embodiment, wherein, the water diversion unit also comprises a locating mechanism, a locating groove coupling with the locating mechanism is arranged on the water diversion body, a locating hole coupling with the locating mechanism is opened on the end face of the second pivot joint part.

In a preferred embodiment, the locating groove is arranged on the first end face of the water diversion body.

In a preferred embodiment, the water diversion body is communicated with the water passage through the passage cavity.

In a preferred embodiment, each of the two outlet functions respectively comprises an independent outlet passage in the outlet unit.

In a preferred embodiment, it also comprises a chuck used for fixedly connecting the outlet unit and the body to the pivot joint site.

Another technical proposal to solve the technical matters in the present invention is:

Folding clamshell shower, it comprises a body containing water passage, a water diversion unit and a outlet unit, the outlet unit is rotationally and pivotally connected with the body to form the folding clamshell structure; the outlet unit is provided with at least two outlet functions; the water diversion unit is mounted at the rotary pivot joint site of the outlet unit and the body, and comprises a water diversion body; the rotation of the water diversion body relative to the body can be driven by the rotation between the outlet unit and the body, the relative rotation between the water diversion body and the body controls outlet functions of the shower to pause or switch.

In a preferred embodiment, the body comprises a handle, a mandrel and a lower cover, the mandrel is mounted in the handle; a water passage is arranged in the mandrel, the first inlet passage and the second inlet passage communicating with the water passage in the mandrel are arranged in the handle; a second pivot joint part is extended upward from the handle, and the first outlet passage opening and the second outlet passage opening respectively communicating with the first inlet passage and the second inlet passage are opened in the second pivot joint part.

In a preferred embodiment, the outlet unit provided with two function comprises: the outlet face cover, the draining mouth, the water diversion plate and the outlet body, the water diversion plate is mounted in the outlet body to define the waterfall water cavity and the shower water cavity; two first pivot joint part are extended downward from the lower end of the outlet body, the waterfall inlet and the shower inlet are arranged in the inner bores of the two first pivot joint parts respectively.

In a preferred embodiment, the two first pivot joint part are sleeved to the two sides of the second pivot joint part, and a folding and turning pivotal connection relationship is formed by the body and the outlet unit through the coupling of the two pivot joint parts.

In a preferred embodiment, the water diversion body comprises the first water diversion shaft and the second water diversion shaft; the first inlet is opened on the shaft wall of the first water diversion shaft, and the first water diversion shaft is communicated with the first water passing cavity and the first outlet; the second inlet is opened on the shaft wall of the second water diversion shaft, and the second water diversion shaft is communicated with the second water passing cavity and the second outlet; the bolt is arranged at the back end of the first water diversion shaft, and the corresponding screw hole is arranged at the front end of the second water diversion shaft.

In a preferred embodiment, the first water diversion shaft and the second water diversion shaft are screwed to each other to work as a revolving shaft, and to run through the first pivot joint part and the second pivot joint part, and are fixedly connected to the two first pivot joint part.

In a preferred embodiment, the first water diversion shaft is always communicated with the waterfall inlet of the outlet body, the second outlet of the second water diversion shaft is always communicated with the shower inlet of the outlet body.

In a preferred embodiment, the first water diversion shaft and the second water diversion shaft are all formed by two-time injection molding with two kinds of material, and the sealing material is on their surface.

Compared with the mechanism at the prior art, the advantages of the present invention are:

1 The folding clamshell mechanism is introduced to make the present novel and more fun when showering, the switching of the outlet functions is controlled by the outlet unit and the folding clamshell mechanism provided with rotary pivot joint relation, so that the users can control the shower during the folding and turning process with novel operation method;

2 The switching or pause of different outlet passages is achieved by the coupling of the pivot joint site that is between the water diversion unit and the outlet unit and the body, a plurality of inlet openings designed in the water diversion body, locating groove and the curved slot with the outlet unit and the body;

3 Apart from the water diversion unit at the pivot joint site of the outlet unit and the body, a chuck is used for fixing the outlet unit and the body, and preventing their falling off, and making sure of the tightness of the connection;

4 A locating mechanism arranged in the pivot joint part is used for locating the default turning angles between the outlet unit and the body with enhanced using stability and good switching feeling;

5 Because of the introduction of the folding clamshell mechanism, only a locating groove is arranged on the first end face of the water diversion body with low cost and simple working process compared with the at least three locating grooves in the traditional structure;

6 Because three positional relations for the locating of the outlet unit relative to the body are present in the folding clamshell mechanism, it is more visual and easier to understand the using status of the shower during the using process;

7 A plastic cup arranged at the outlet on the end face of the second pivot joint part is coupling with a elastic part to be against the first end face 211 of the water diversion body 210 and seals the outlet 511, so that the stability of the pause and the water passage switching is enhanced;

8 The using process is not only novel, easy and labor-saving, but also fits the trend of the human industrial design, which makes the users enjoy the fun of shower and greatly satisfies the using demands of the users.

BRIEF DESCRIPTION OF THE DRAWINGS

With the following description of the drawings and specific embodiments, the invention shall be further described in details.

DESCRIPTION OF THE PREFERRED EMBODIMENTS

Embodiment 1

With reference of FIG. 1 to FIG. 10, a preferred embodiment of the folding clamshell shower in the present invention is described in the embodiment 1.

Figure 1:
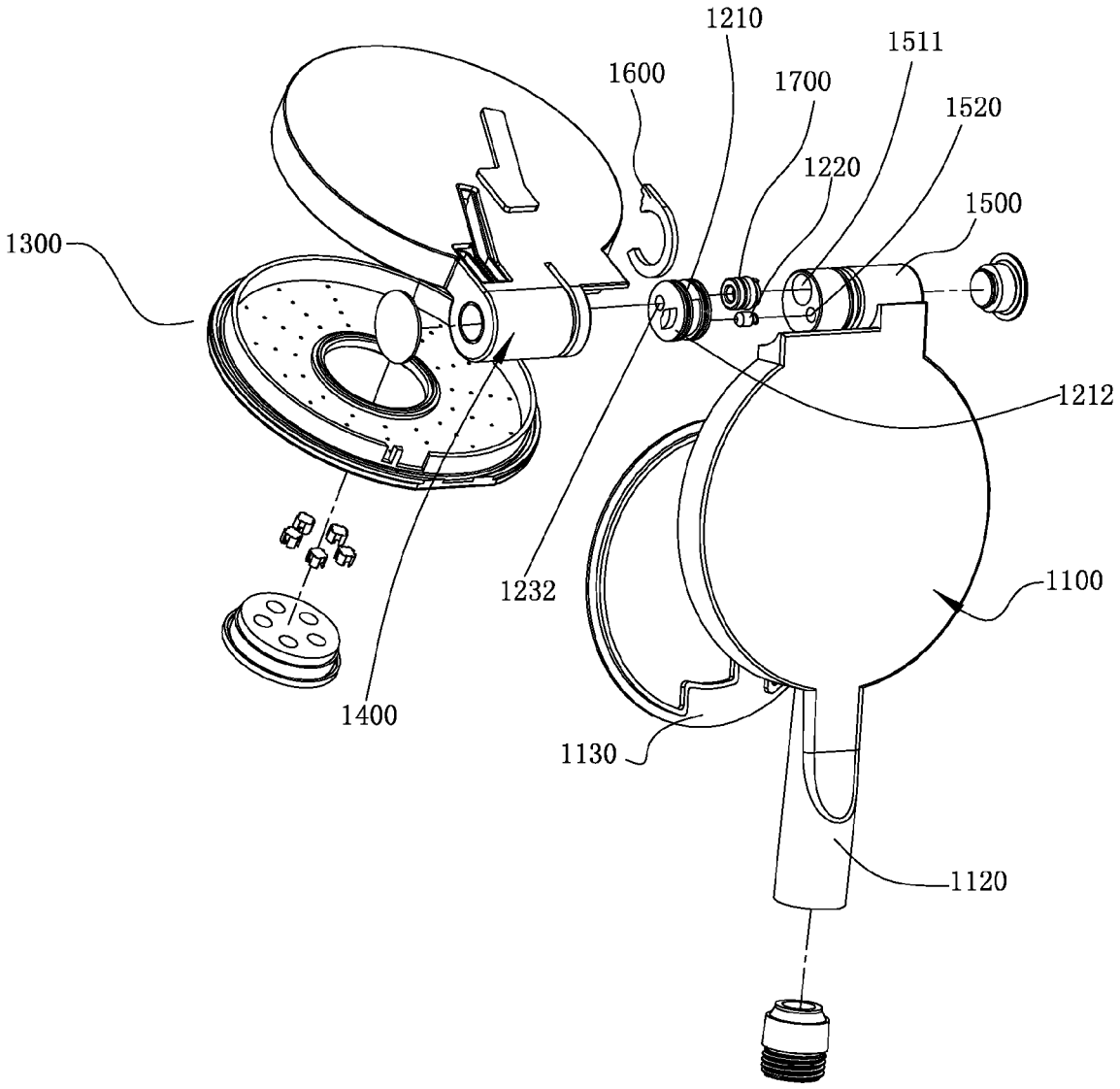
FIG. 1 shows the first solid exploded view of the folding clamshell shower of the embodiment 1 in the present invention.
Figure 2:
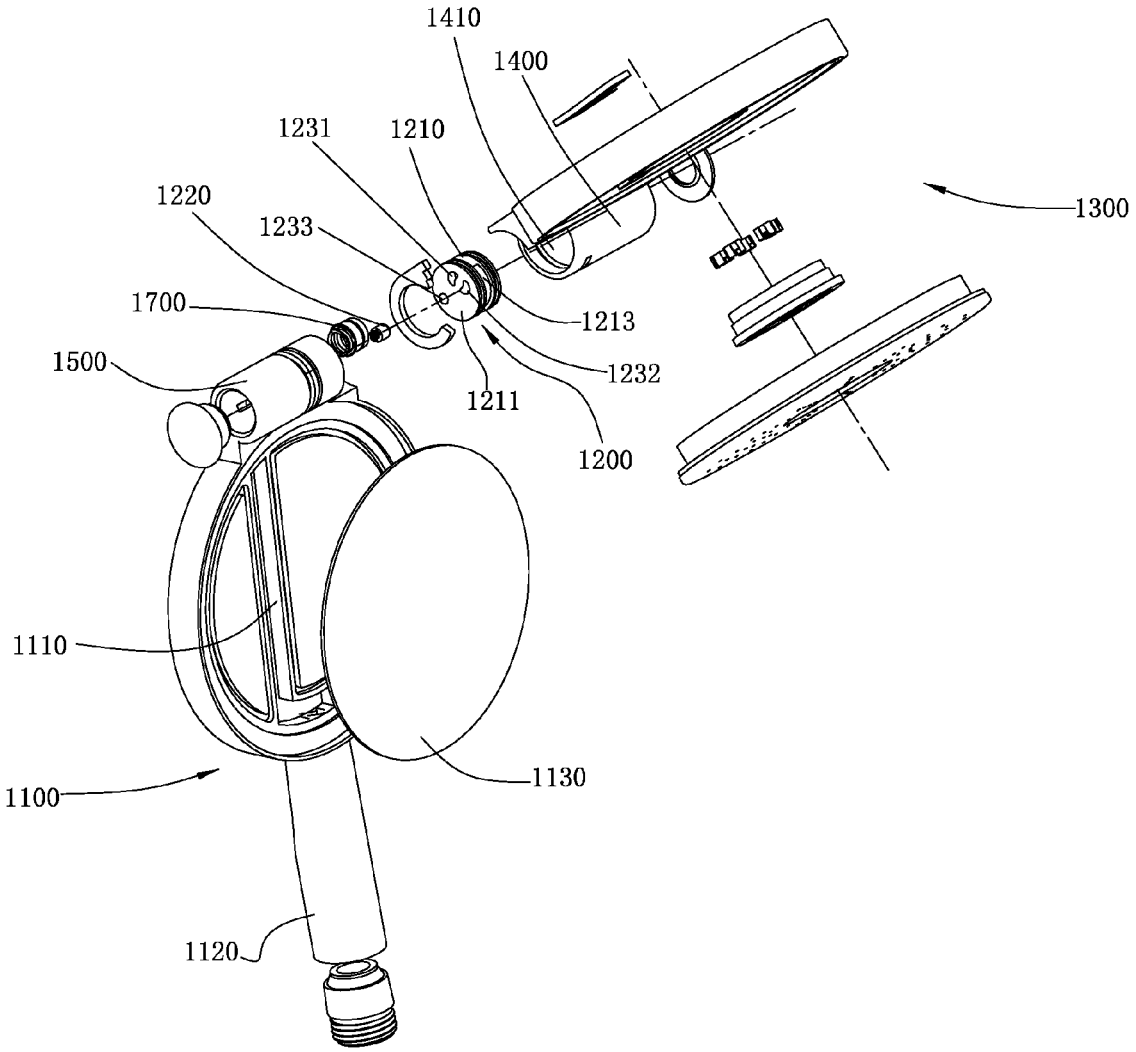
FIG. 2 shows the second solid exploded view of the folding clamshell shower of the embodiment 1 in the present invention.

According to FIG. 1 and FIG. 2, the folding clamshell shower comprises:

Body 1100, which comprises a handle 1120, a water passage 1110 that is communicated with the water resource and extends from the inside of the handle to the pivot joint site of the body 1100 and the outlet unit 1300 with a lower cover 1130 as shown in FIG. 2, and the pivot joint site of the body 1100 and the outlet unit 1300 comprises two pivot joint parts, and the second pivot joint part 1500 is fixedly connected to the side of the body 1100;

An outlet unit 1300, which is rotationally and pivotally connected with the body 1100 to form the folding clamshell structure;

The outlet unit 1300 is provided with two outlet functions which are atomizing water and the shower water in the present embodiment, and the two outlet functions are provided with independent the first and the second outlet passage 1310 and 1320 respectively which are all arranged in the outlet unit 1300, and in the two pivot joint parts, the first pivot joint part 1400 is sleeved with the second pivot joint part 1500 and fixedly connected to the side of the outlet unit 1300, and a folding and turning pivotal connection relationship is formed by the body 1100 and the outlet unit 1300 through the coupling of the two pivot joint parts.

A water diversion unit 1200, which is mounted at the rotary pivot joint site of the outlet unit 1300 and the body 1100 and comprises a water diversion body 1210, and the water diversion body is a podetium mounted in the water diversion unit 1200 with the first end face 1211 and the second end face 1212 which are corresponding to each other front and back, and the first inlet opening 1231 and the second inlet opening 1232 are symmetrically arranged on the first end face 1211, which are communicated with the first outlet passage 1310 and the second outlet passage 1320 respectively, and the second inlet opening 1232 runs through the podetium to the second end face 1212, a curved slot 1213 communicating with the first inlet opening 1231 is opened on the side of the podetium, and the first inlet opening 1231 can be communicated with the first outlet passage 1310 of the outlet unit 1300 through the curved slot 1213; the water diversion body 1210 can rotate relatively to the body 110 driven by the rotation between the body 1100 and the outlet unit 1300, and the two inlet opening 1231 and 1232 can be communicated with, simultaneously staggered or respectively staggered to the outlet 1211 of the passage cavity 1510 for the pausing and the switching of the two outlet functions of the present folding clamshell shower.

The water diversion unit also comprises a locating mechanism, the locating mechanism comprises a locating pin 1220 and a elastic part coupling with the locating pin 1220, and a locating groove 1233 that is coupling with and against the locating pin 1220 is arranged on the first end face 1211 of the water diversion body 1210, and the locating pin 1220 is against the locating groove 1233 of the first end face of the water diversion body 1210 for the locating of the outlet unit 1300 when the outlet unit 1300 rotates to the two default angles around the pivot joint site and relatively to the body 1100.

The coupling principle of the water diversion unit 1200 and the body 1100, the outlet unit 1300 is: a groove 1410 containing the water diversion body 1210 of the water diversion unit 1200 is opened in the first pivot joint part 1400, and a passage cavity 1510 always communicating with the water passage 1110 is opened in the second pivot joint part 1500, the outlet 1511 of the passage cavity is arranged at the end face of the second pivot joint part 1500, and the first end face 1211 of the water diversion body 1210 is against the end face of the second pivot joint part and alternatively communicated with the water resource through the passage cavity 1510 and the water passage 1110, a plastic cup 1700 is arranged at the adjoin site of the second pivot joint part 1500 and the water diversion body, which is coupling with a elastic part and against the first end face 1211 of the water diversion body 1210 to seal the outlet 1511, and a locating hole 1520 containing the locating pin 1220 of the locating mechanism is opened on the end face of the second pivot joint part 1500.

A curved chuck 1600, two slots are opened on the external surrounding walls of the two pivot joint parts 1400 and 1500 respectively, and the two end of the chunk 1600 are provided with two hooks that are spliced in the two slots respectively, and its arc is coupling with the external surrounding walls of the two pivot joint parts for fixing the outlet unit 1300 and the body 1100 to the pivot joint parts, making the connection stronger and preventing the falling off.

As shown from FIG. 3 to FIG. 10, three positional relations for the locating of the outlet unit 1300 with respect to the body 1100 between the outlet unit 1300 comprising two outlet functions and the body 1100.

Figure 3:
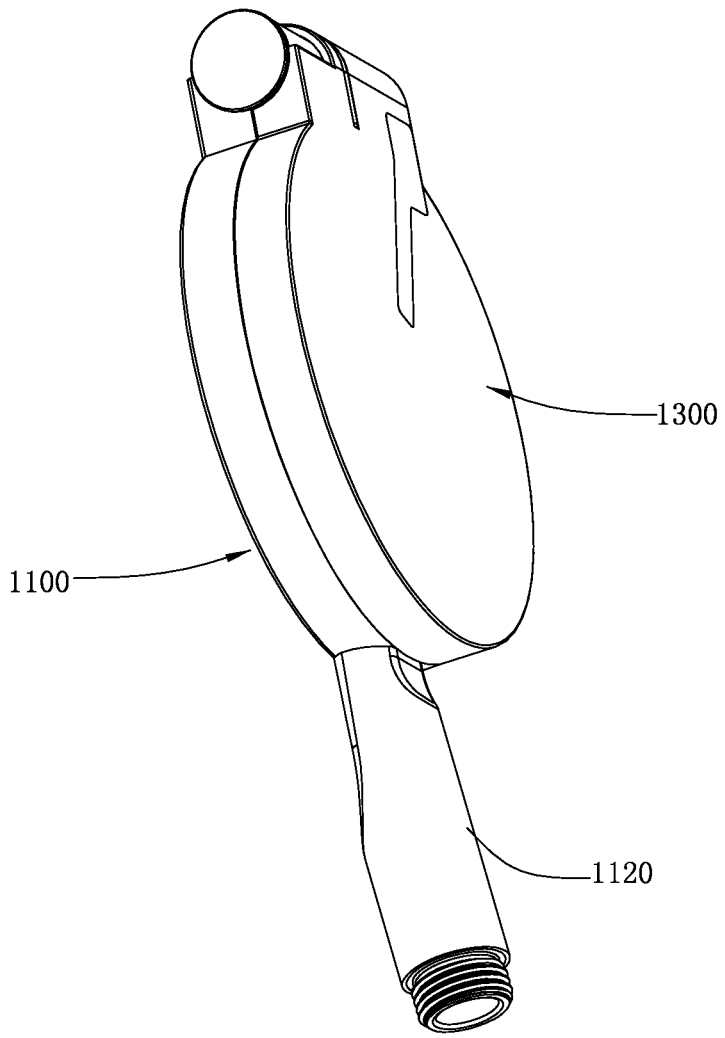
FIG. 3 shows the solid abridged general view of the folding clamshell shower of the embodiment 1 in the present invention, when the shower is at the first position.
Figure 4:
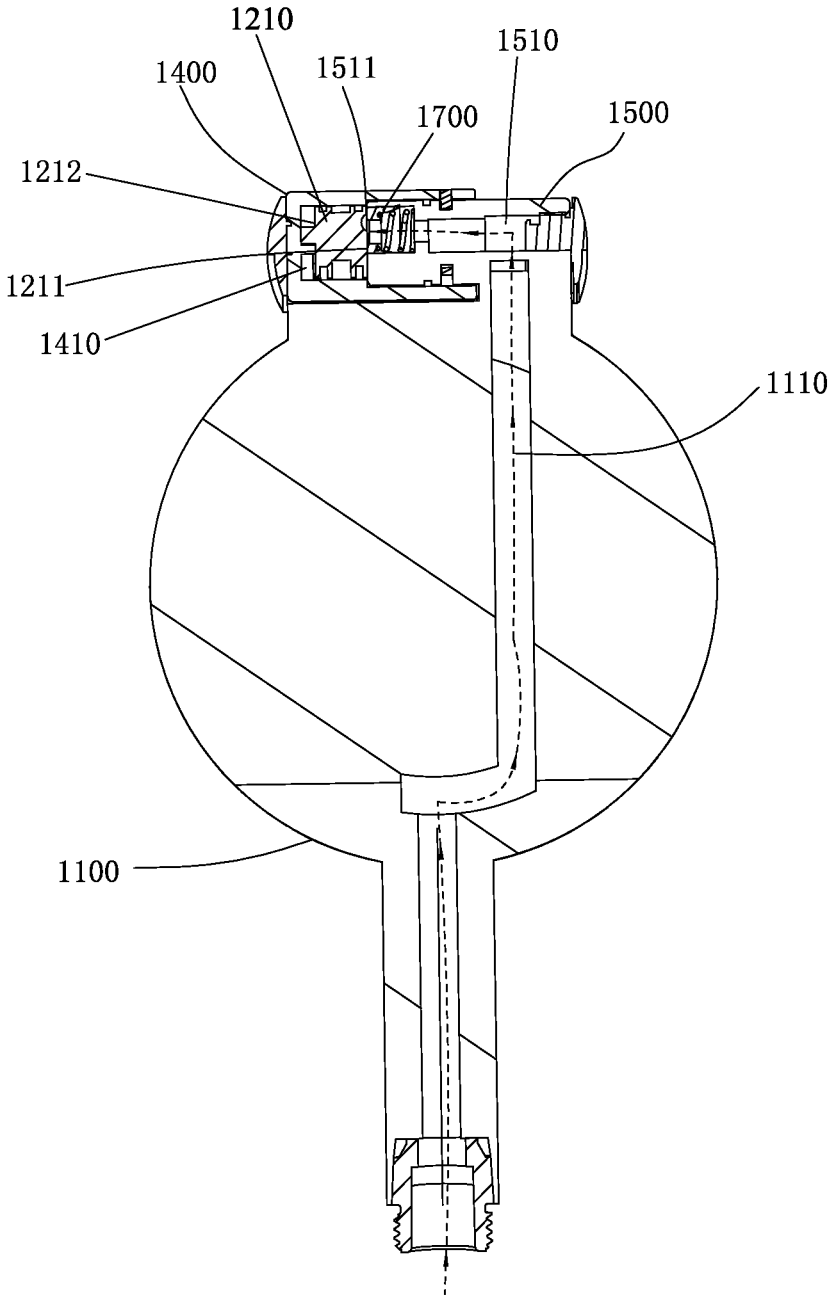
FIG. 4 shows the cut-open view of the folding clamshell shower of the embodiment 1 in the present invention, when the shower is at the first position.

When the first position is present, according to FIG. 3 and FIG. 4, the outlet unit 1300 covers the body 1100 with no rotation, if the water resource is open at the moment, water current enters the passage cavity 1510 along the water passage 1110, and because the outlet 1511 is staggered away from the two inlet openings of the first end face 1211 of the water diversion body, water current cannot enter the inlet opening of the water diversion body 1210, so that water current cannot enter the outlet unit, and then water does not come out of the present folding clamshell shower.

Figure 5:
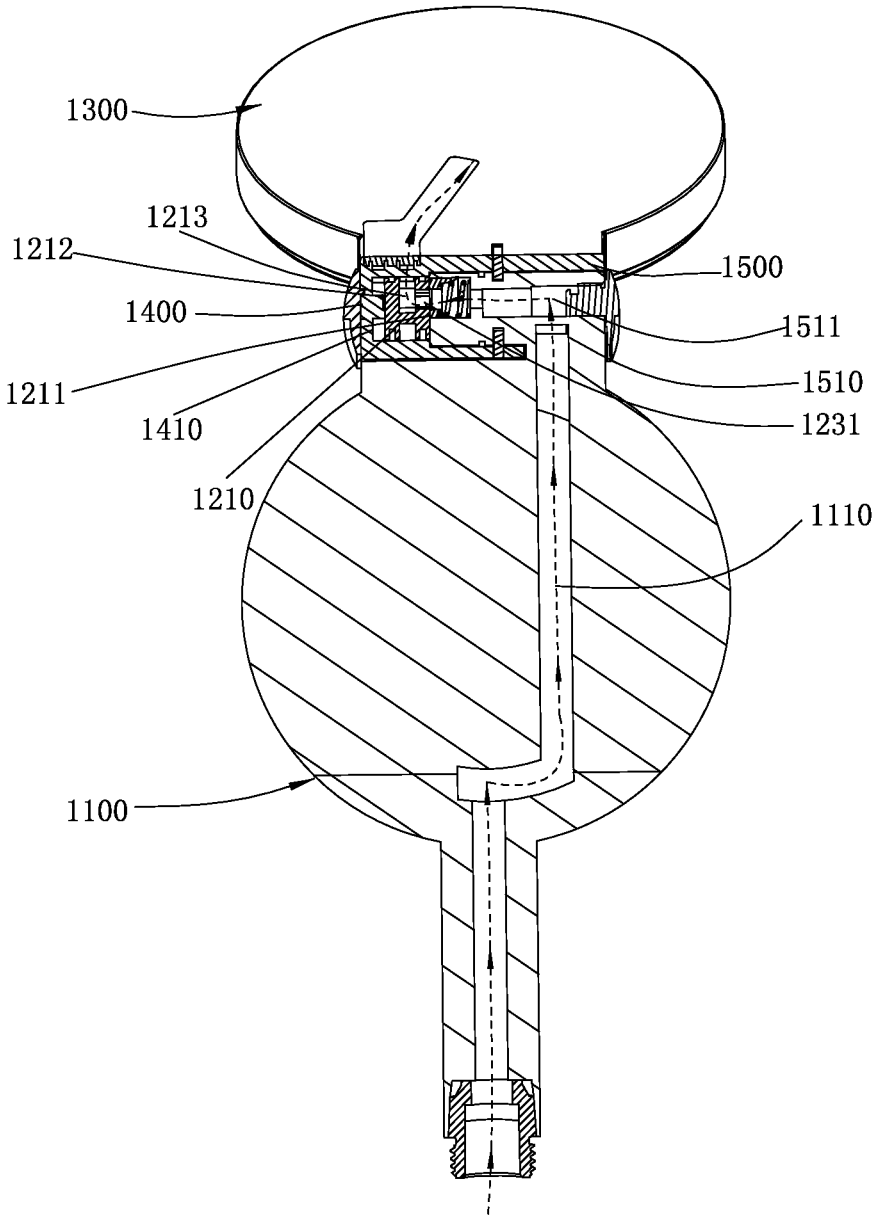
FIG. 5 shows the first cut-open view of the folding clamshell shower of the embodiment 1 in the present invention, when the shower is at the second position.
Figure 6:
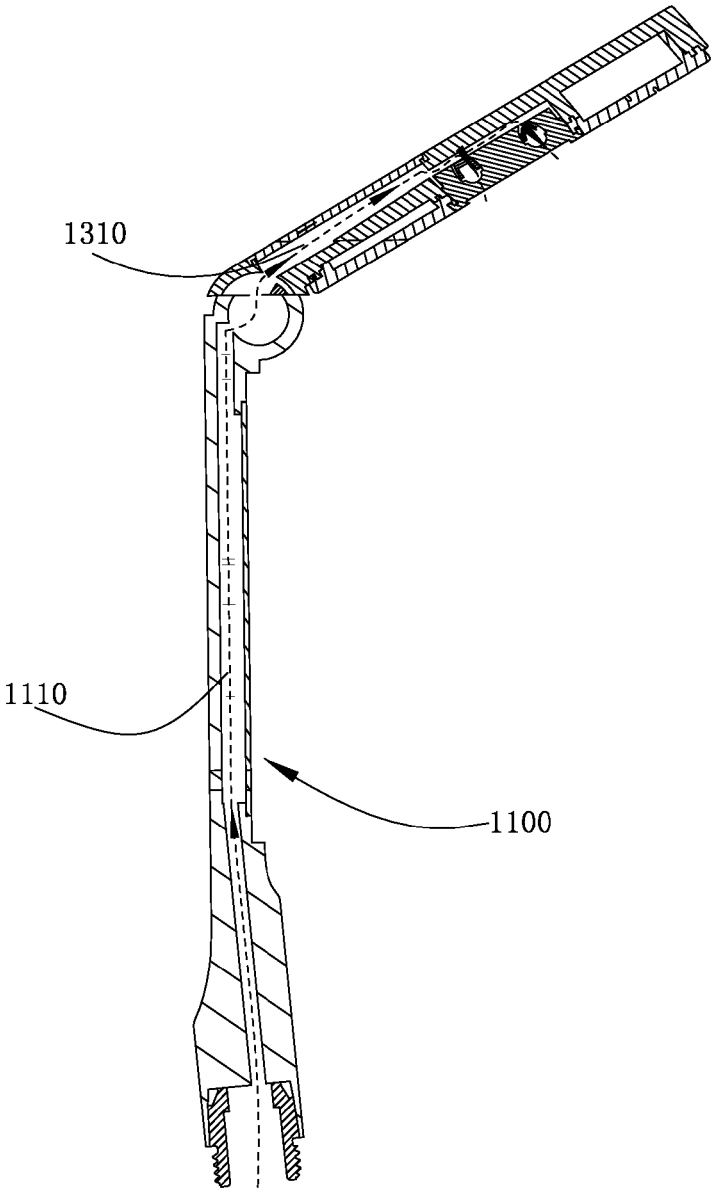
FIG. 6 shows the second cut-open view of the folding clamshell shower of the embodiment 1 in the present invention, when the shower is at the second position.
Figure 7:
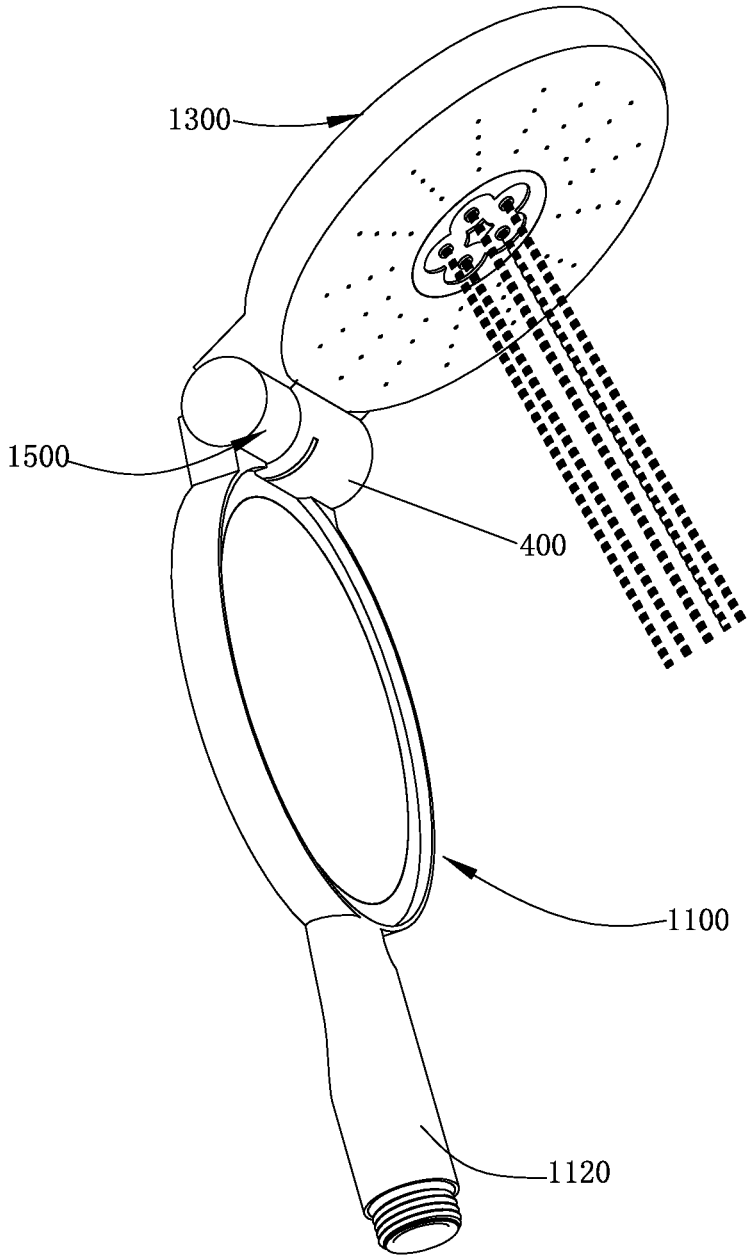
FIG. 7 shows the outlet abridged general view of the folding clamshell shower of the embodiment 1 in the present invention, when the shower is at the second position.

When the second position is present, according to FIGS. 5, 6 and 7, the outlet unit 1300 is open and rotates around the pivot joint part and relative to the body 1100, locating at the first default angle through the locating pin 1210, and the outlet 1511 is aligned to the first inlet opening 1231 of the first end face 1211 of the water diversion body 1210, and because the first inlet opening 1231 is communicated with the curved slot 1213 at the side of the water diversion body 1210 and the second inlet opening 1232 is staggered away from the outlet 1511 and the curved slot 1213 is communicated with the first outlet passage 1310 of the outlet unit 1300, water current enters the above-mentioned path along the water passage 1110, and water comes out of the first outlet function of the present folding clamshell shower at the moment with atomizing water.

Figure 8:
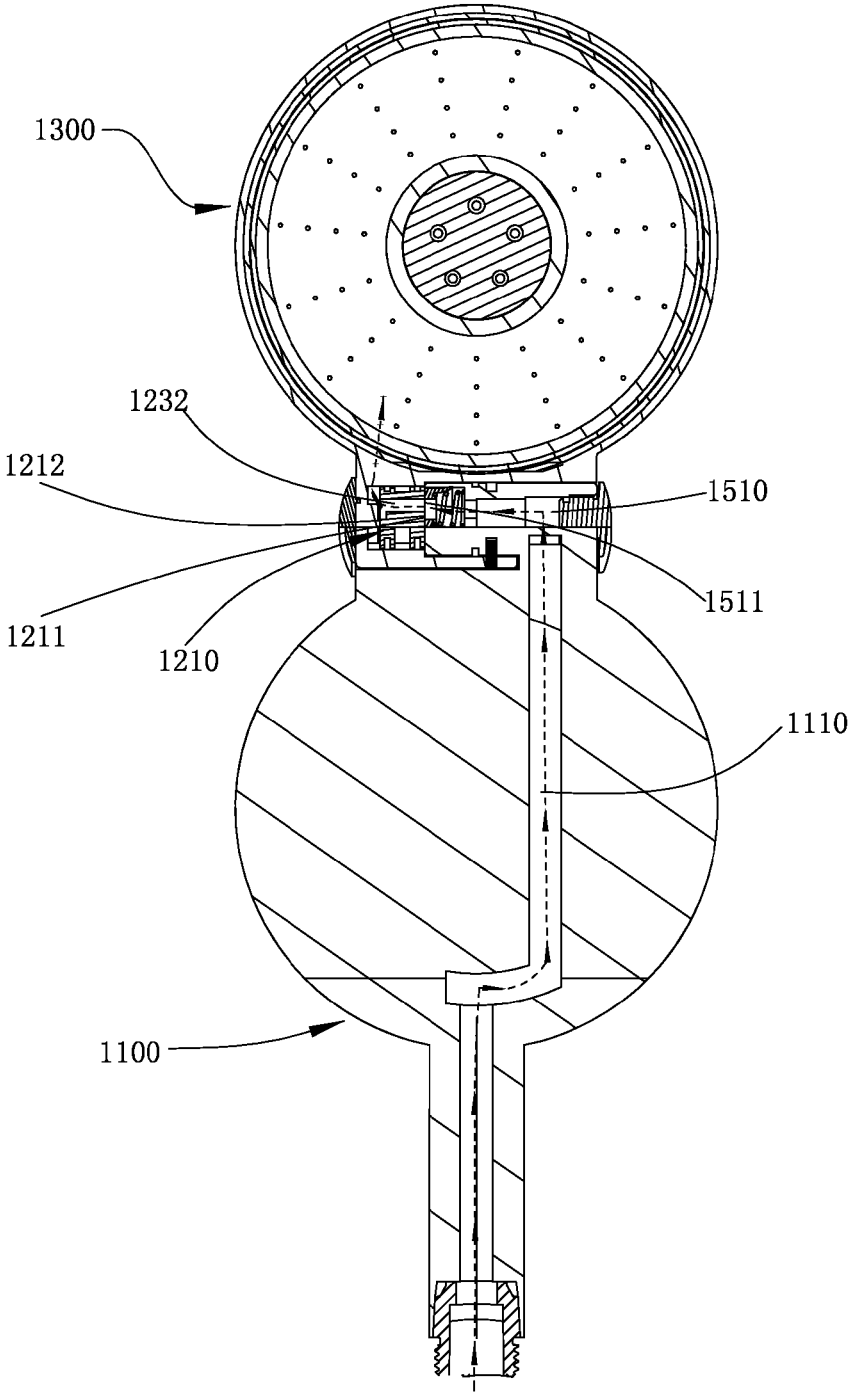
FIG. 8 shows the first cut-open view of the folding clamshell shower of the embodiment 1 in the present invention, when the shower is at the third position.
Figure 9:
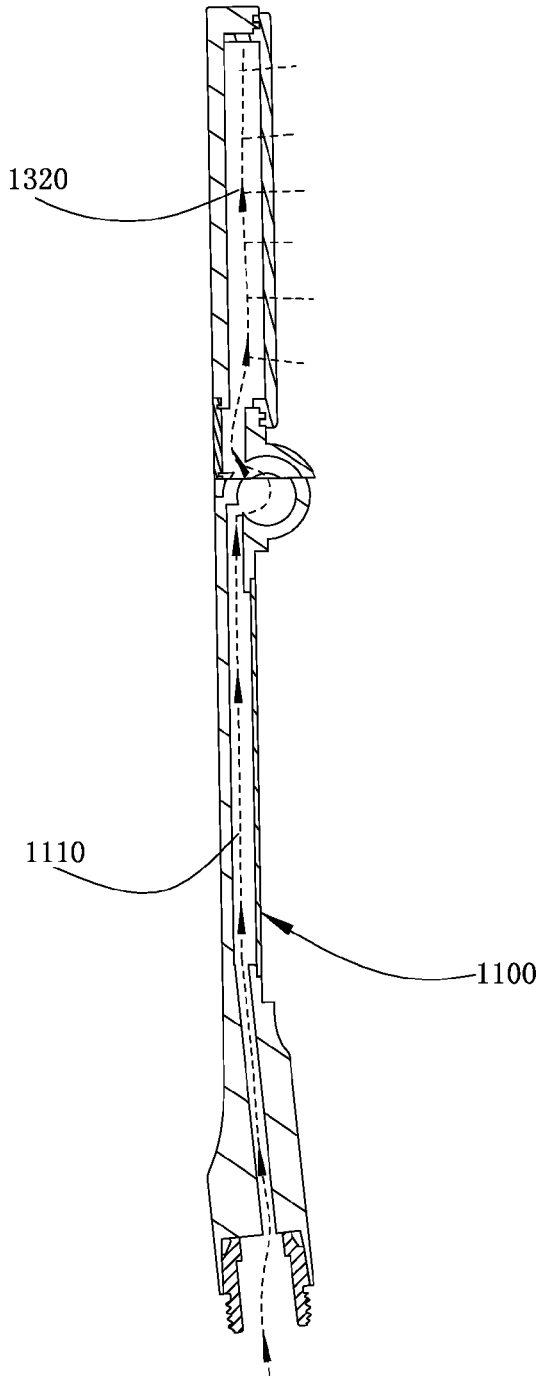
FIG. 9 shows the second cut-open view of the folding clamshell shower of the embodiment 1 in the present invention, when the shower is at the third position.
Figure 10:
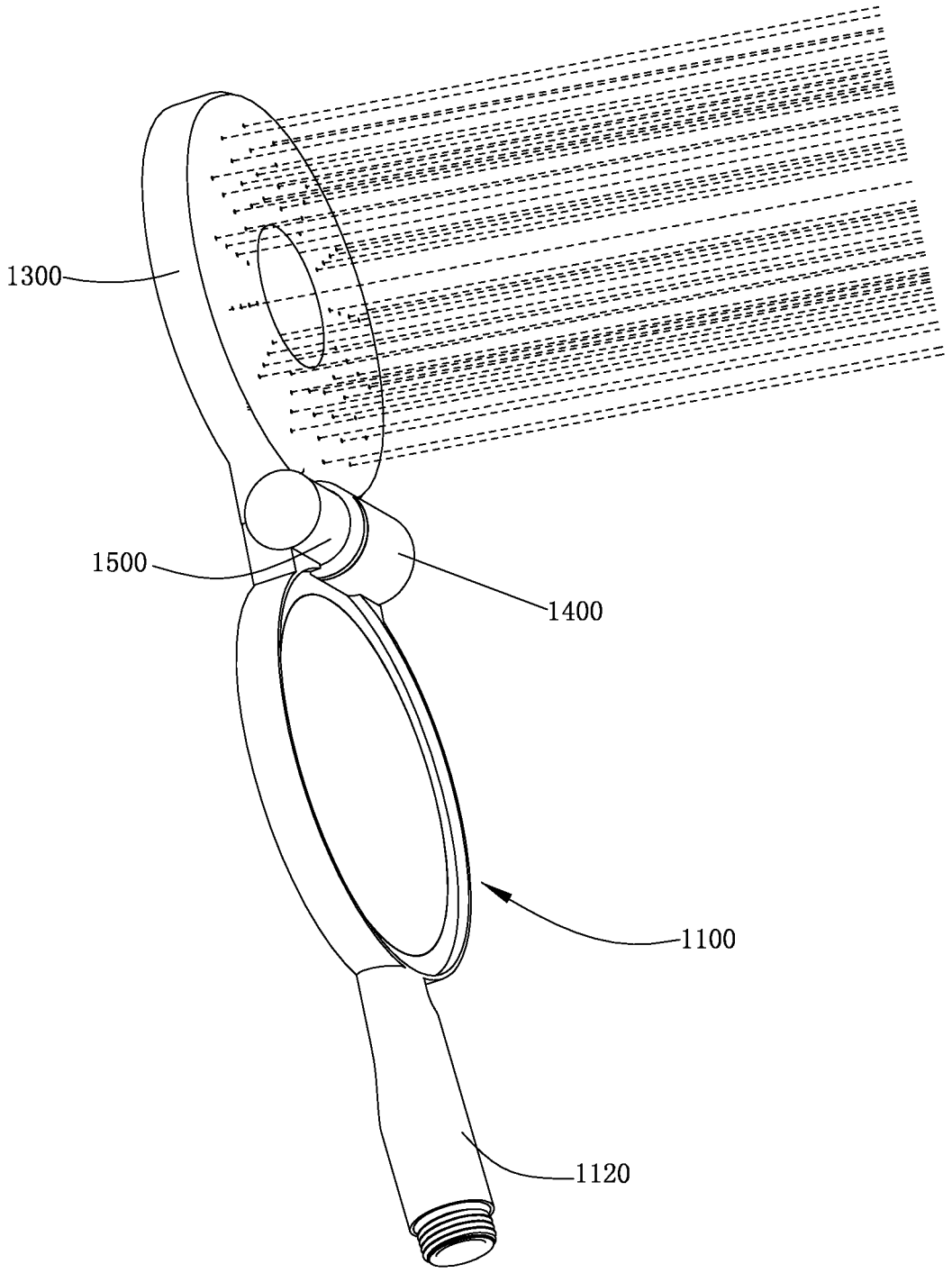
FIG. 10 shows the outlet abridged general view of the folding clamshell shower of the embodiment 1 in the present invention, when the shower is at the third position.

When the third position is present, according to FIGS. 8, 9 and 10, keep turning the outlet unit 1300 for maintaining the second default angle) (180°, the outlet 1511 will be aligned to the second inlet opening 1232 of the first end face 1211 of the water diversion body 1210 and staggered away from the first inlet opening 1231 at the moment, and after opening the water resource, the water current will enter the water passage 1110, the passage cavity 1510, the second inlet opening 1232 of the water diversion body and the second outlet passage 1320 in turn, so that water comes out of the second outlet function of the present folding clamshell shower with shower water.

Of course, the two default angles is not limited at fixed angle and can be adjusted according to practical demands. And according to the same principle, the present folding clamshell shower is not limited to the two outlet functions in the present embodiment, and is provided with more or less outlet functions through the structure design of the water diversion body.

Embodiment 2

With reference of FIG. 11 to FIG. 18, another preferred embodiment of the folding clamshell shower in the present invention is described in the embodiment 2.

Figure 11:
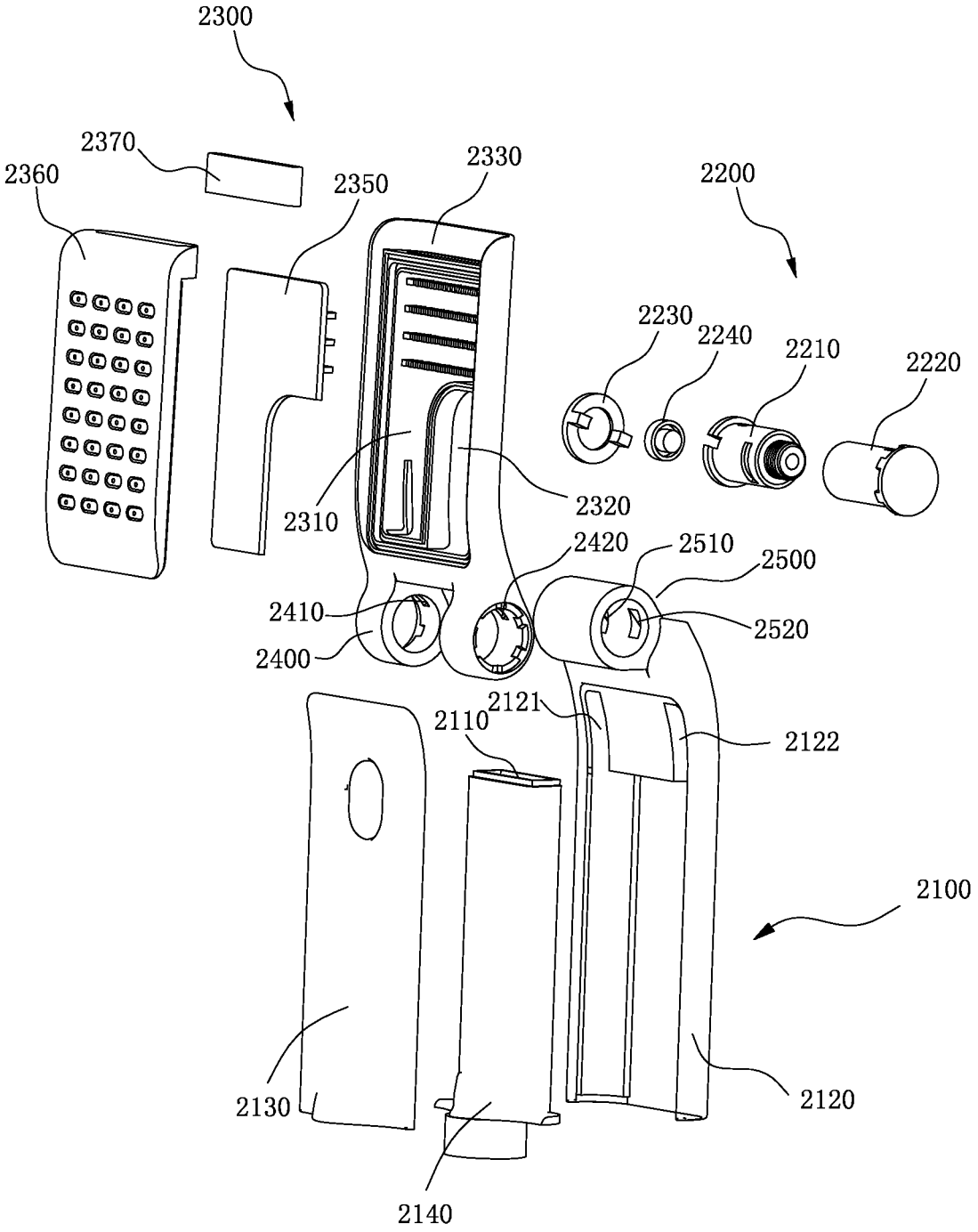
FIG. 11 shows the solid exploded view of the folding clamshell shower of the embodiment 2 in the present invention.
Figure 12:
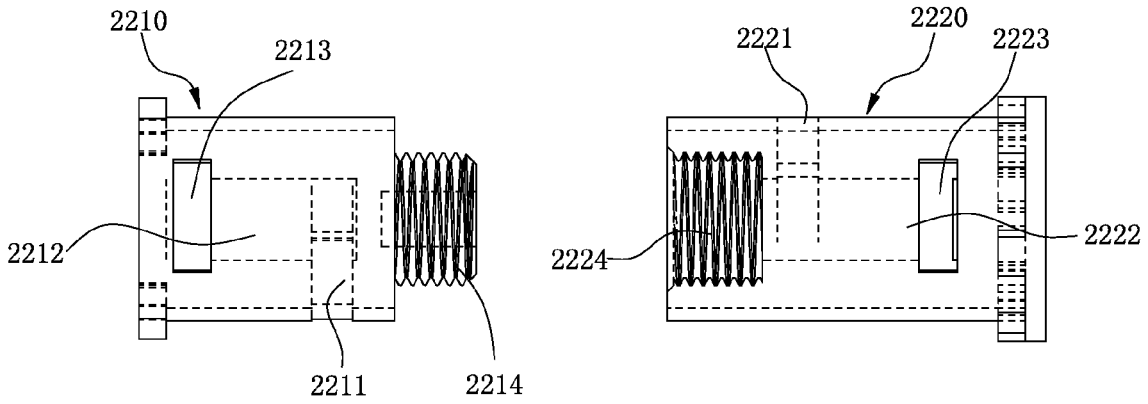
FIG. 12 shows the partial exploded view of the water diversion body of the folding clamshell shower of the embodiment 2 in the present invention.

According to FIGS. 11 and 12, the folding clamshell shower mainly comprises: the body 2100, the outlet unit 2300 and the water diversion unit 2200.

The body 2100 comprises a handle 2120, a mandrel 2140 and a lower cover 2130, a water passage 2110 is arranged in the mandrel 2140, and the mandrel 2140 is mounted in the handle 2120, and the lower cover 2130 covers the mandrel 2140. The first inlet passage 2121 and the second inlet passage 2122 are arranged in the handle 2120, and the first inlet passage 2121 and the second inlet passage 2122 are communicated with the water passage 2110 in the mandrel; a second pivot joint part 2500 is extended upward from the handle 2120, the first outlet passage opening 2510 and the second outlet passage opening 2520 are opened in the second pivot joint part 2500; the first outlet passage opening 2510 is communicated with the first inlet passage 2121, the second outlet passage opening 2520 is communicated with the second inlet passage 2122.

The outlet unit 2300, which is rotationally and pivotally connected with the body 2100 to form the folding clamshell structure;

The outlet unit 2300 is provided with two outlet functions, which comprises: the outlet face cover 2360, the draining mouth 2370, the water diversion plate 2350 and the outlet body 2330, the water diversion plate 2350 is arranged in the outlet body 2330 to define the waterfall water cavity 2310 and the shower water cavity 2320, the outlet face cover 2360 is mounted at the front end of the outlet body 2330, the draining mouth 2370 is mounted at the top of the outlet body 2330. Two first pivot joint parts 2400 are extended downward from the lower end of the outlet body 2330, and the waterfall inlet 2410 and the shower water inlet 2420 are arranged in the inner bores of the two first pivot joint parts 2400 respectively; the two first pivot joint parts 2400 is sleeved to the two sides of the second pivot joint part 2500, and a folding and turning pivotal connection relationship is formed by the body 2100 and the outlet unit 2300 through the coupling of the two pivot joint parts.

The water diversion unit 2200, which is mounted at the rotary pivot joint site of the outlet unit 2300 and the body 2100 and comprises the first water diversion shaft 2210 and the second water diversion shaft 2220; the first inlet 2211 is opened on the shaft wall of the first water diversion shaft 2210, and the first water diversion shaft 2210 is communicated with the first water passing cavity 2212 and the first outlet 2213; the second inlet 2221 is opened on the shaft wall of the second water diversion shaft 2220, and the second water diversion shaft 2220 is communicated with the second water passing cavity 2222 and the first outlet 2233; the bolt 2214 is arranged at the back end of the first water diversion shaft 2210, and the corresponding screw hole 2224 is arranged at the front end of the second water diversion shaft.

The first water diversion shaft 2210 and the second water diversion shaft 2220 are all formed by two-time injection molding with two kinds of material, and the sealing material is on their surface.

The first water diversion shaft 2210 and the second water diversion shaft 2220 in the present embodiment are screwed to each other to work as a revolving shaft, and to run through the first pivot joint part 2400 and the second pivot joint part 2500, and is fixedly connected to the two first pivot joint part 2400, and a spiral-connecting part 2240 is screwed to the end of the revolving shaft with an overlay 2230. The first outlet 2213 of the first water diversion shaft 2210 is always communicated with the waterfall inlet 2410 of the outlet body 2330, The second outlet 2223 of the second water diversion shaft 2220 is always communicated with the shower inlet 2420 of the outlet body 2330.

As shown from FIG. 13 to 18, the outlet unit 2300 comprises two outlet functions, waters enter the body 2100 from the mandrel 2140, and then water enter the first inlet passage 2121 and the second inlet passage 2122 respectively.

Figure 13:
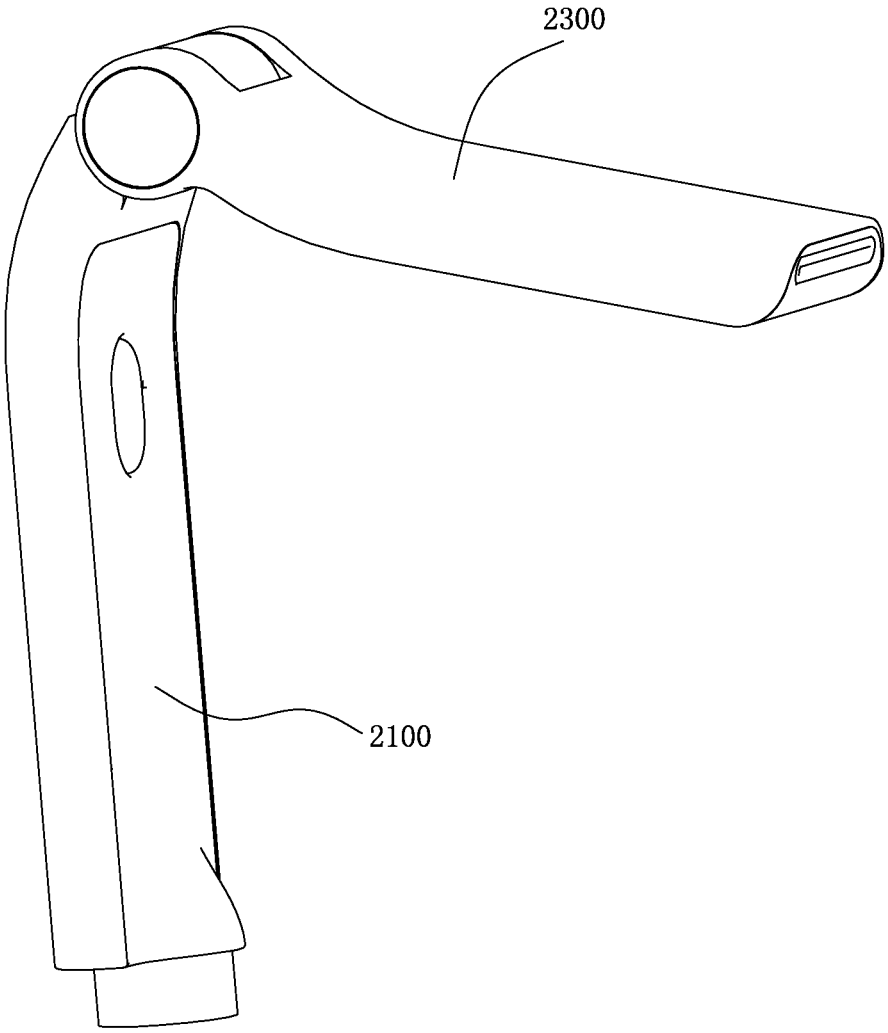
FIG. 13 shows the solid structure abridged general view of the folding clamshell shower of the embodiment 2 in the present invention, when the shower is at the first position.
Figure 14:
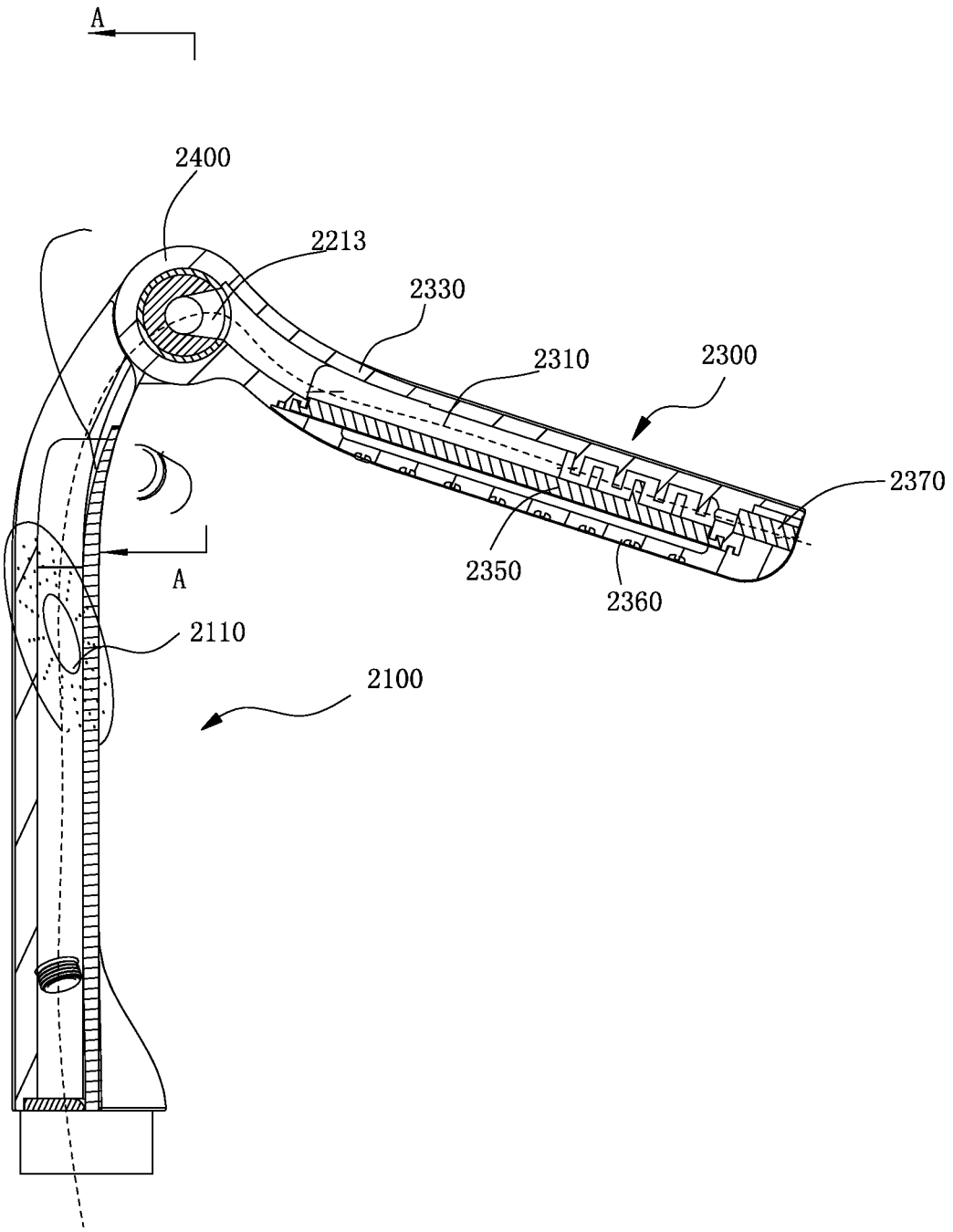
FIG. 14 shows the structure abridged general view of the folding clamshell shower of the embodiment 2 in the present invention, when the shower is at the first position.
Figure 15:
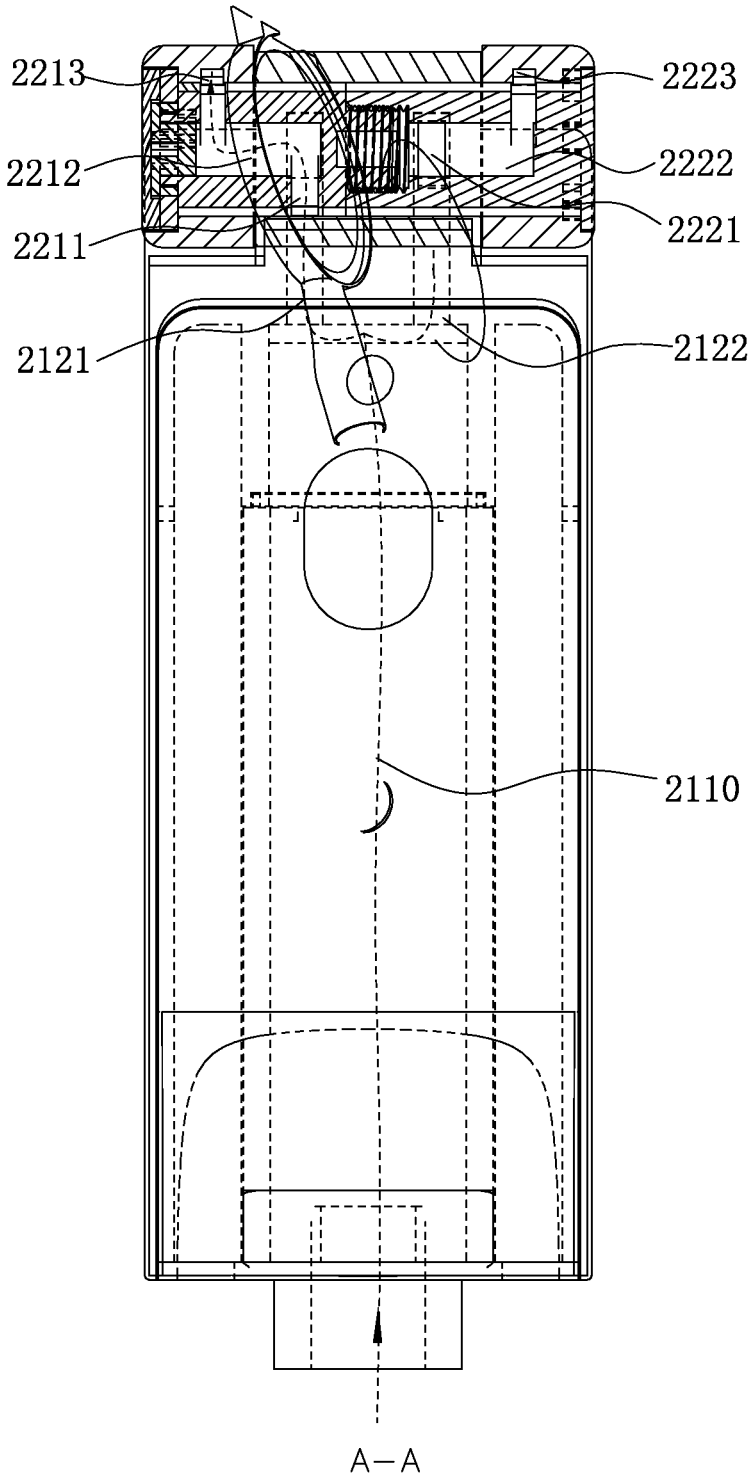
FIG. 15 shows the cut-open view of FIG. 14 A-A.

When the first position is present, according to FIGS. 13, 14 and 15, namely when the angle between the outlet unit 2300 and the body 2100 is 0° to 90°, the first inlet 2211 of the first water diversion shaft 2210 is communicated with the first inlet passage 2121 of the body, and then water enters the waterfall inlet 2410 of the outlet body 2330 from the first outlet 2213 through the first water passing cavity 2212, and then water enters the waterfall water cavity 2310, and the waterfall water comes out of the draining mouth 2370.

Figure 16:
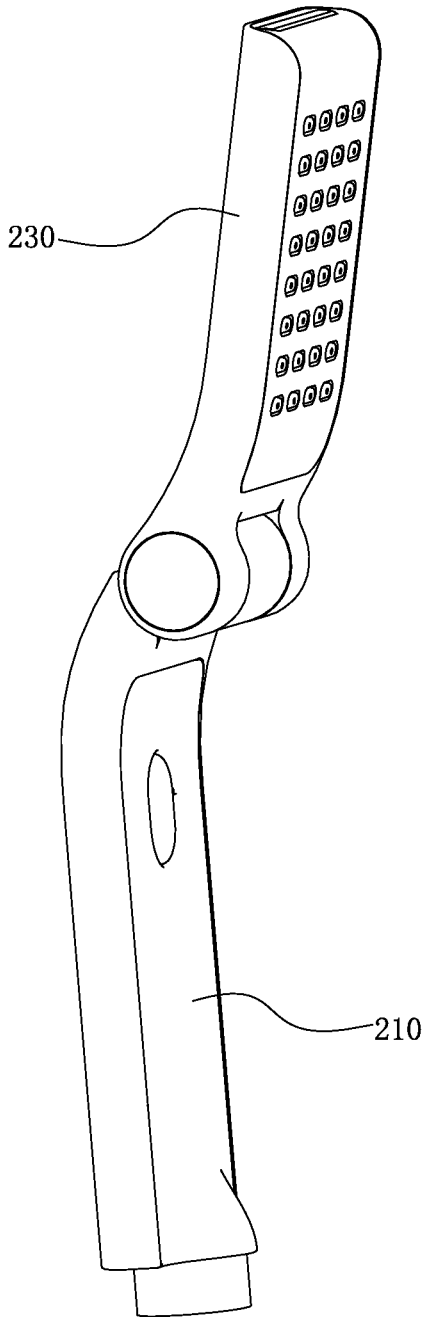
FIG. 16 shows the solid structure abridged general view of the folding clamshell shower of the embodiment 2 in the present invention, when the shower is at the second position.
Figure 17:
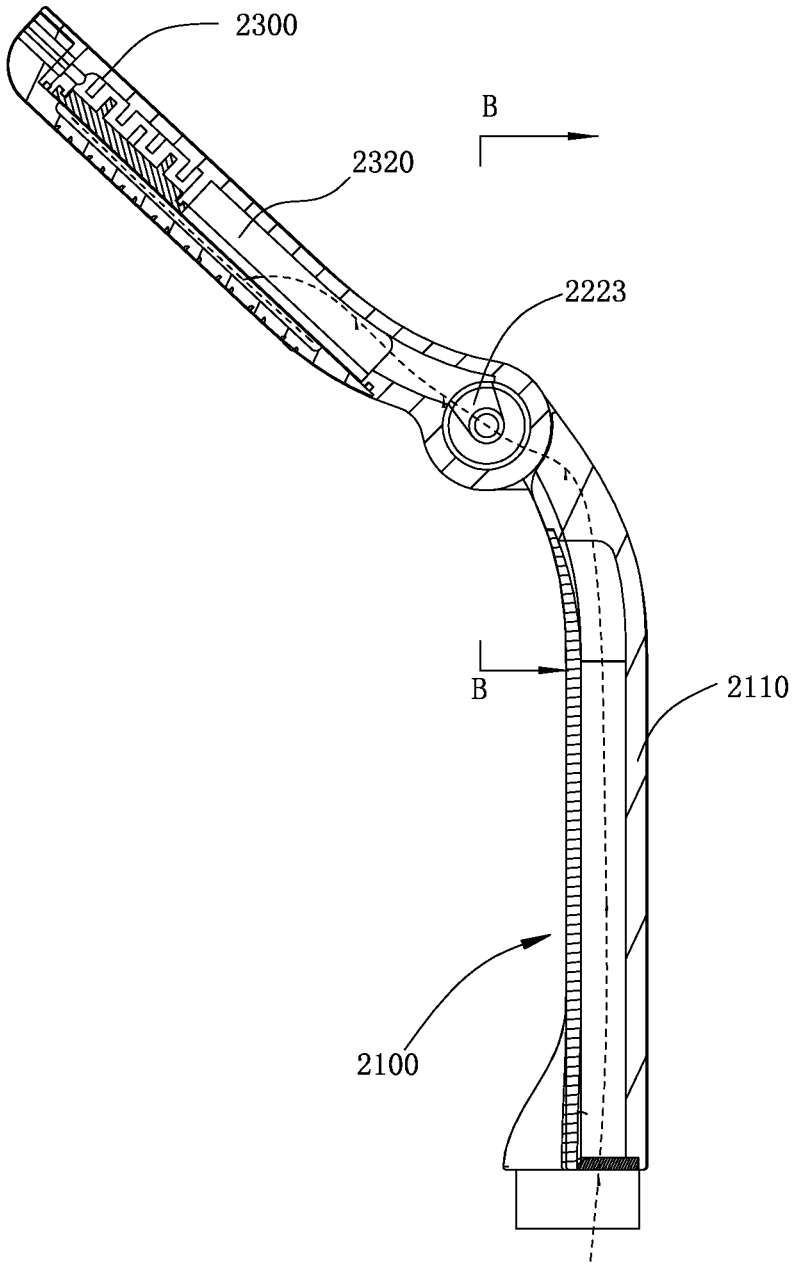
FIG. 17 shows the structure abridged general view of the folding clamshell shower of the embodiment 2 in the present invention, when the shower is at the second position.
Figure 18:
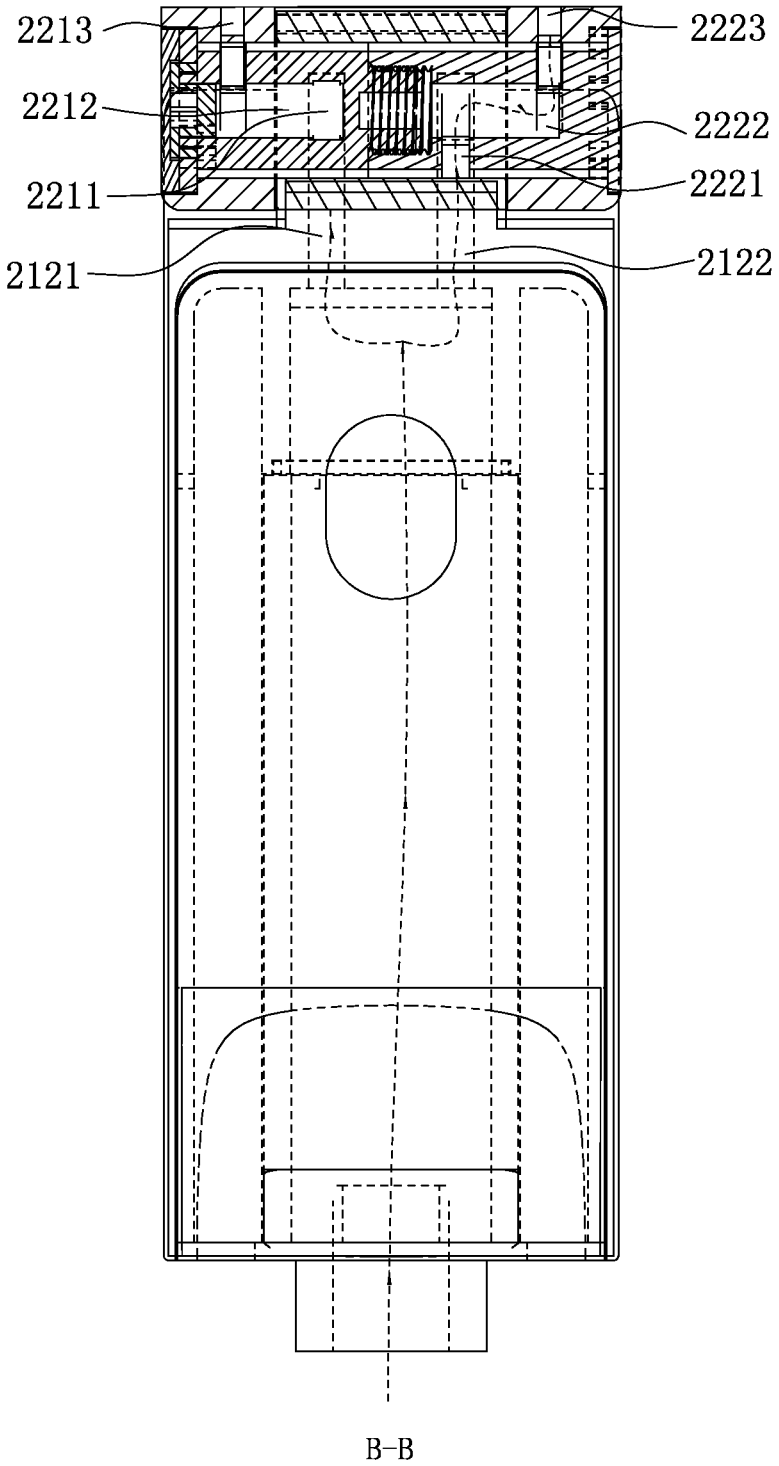
FIG. 18 shows the cut-open view of FIG. 17 B-B.

When the second position is present, according to FIGS. 16, 17 and 18, namely when the angle between the outlet unit 2300 and the body 2100 is 90° to 180°, the second inlet 2221 of the second water diversion shaft 2220 is communicated with the second inlet passage 2122 of the body, and the water enters the shower inlet 2420 of the outlet body 2330 from the second outlet 2223 through the second water passing cavity 2222, and then water enters the shower water cavity 2320, and the shower water comes out of the outlet face cover 2360.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The folding clamshell shower in the present invention controls the pause of the shower and the switching of the outlet functions through the relative rotation between the water diversion body and the body. The outlet principle of the folding clamshell shower is simple, and its outlet ways is novel. The showering fun and the principle fitting to the industrial design are all achieved.

What is claimed is:

1. Folding clamshell shower, comprising:

a body containing a water passage, further comprising a water diversion unit, and an outlet unit, wherein the outlet unit is rotationally and pivotally connected with the body at a rotary pivot joint site to form the folding clamshell structure, such that the outlet covers at least part of the body when folded inwardly to close the shower;

the outlet unit is provided with at least two outlet functions;

the water diversion unit is mounted at the rotary pivot joint site of the outlet unit and the body, and comprises a water diversion body;

the rotation of the water diversion body relative to the body is configured to be driven by the rotation between the outlet unit and the body, so that the relative rotation between the water diversion body and the body selects between the at least two outlet functions of the shower according to an angle between the water diversion body and the body, and pauses the outlet functions of the shower when the shower is closed.

2. Folding clamshell shower according to claim 1, further comprising a first and a second pivot joint part which are sleeved to each other, the first pivot joint part is fixedly connected to a side of the outlet unit, and a groove containing the water diversion body is opened in the first pivot joint part;

the second pivot joint part is fixedly connected to a side of the body with a passage cavity always communicating with the water passage, an outlet of the passage cavity is at an end face of the second pivot joint part, and an end face of the water diversion body is against the end face of the second pivot joint part.

3. Folding clamshell shower according to claim 2, wherein, the water diversion body is a podetium mounted in the water diversion unit with first and second ends, first and second inlet openings communicating with first and second outlet functions respectively are arranged on the first end, and the second inlet opening runs through the podetium to the second end, a curved slot communicating with the first inlet opening is opened on the side of the podetium.

4. Folding clamshell shower according to claim 3, further comprising a plastic cup arranged at the outlet of the second pivot joint part.

5. Folding clamshell shower according to claim 3, wherein, the outlet unit comprises two outlet functions, and the outlet unit and the body are configured to be arranged in at least three positional relations therebetween, in a first position, the outlet unit covers the body, and the outlet is staggered away from the two inlet opening on the first end face of the water diversion body;

in a second and the third position, the outlet is aligned to the first and the second inlet opening on the first end face of the water diversion body respectively.

6. Folding clamshell shower according to claim 2, wherein, the water diversion unit also comprises a locating mechanism, a locating groove coupling with the locating mechanism is arranged on the water diversion body, a locating hole coupling with the locating mechanism is opened on the end face of the second pivot joint part.

7. Folding clamshell shower according to claim 1 further comprising a chuck used for fixedly connecting the outlet unit and the body to the pivot joint site.

8. Folding clamshell shower according to claim 1, wherein, the body comprises a handle, a mandrel and a lower cover, the mandrel is mounted in the handle;

the water passage is arranged in the mandrel, a first inlet passage and a second inlet passage communicating with the water passage in the mandrel are arranged in the handle;

a second pivot joint part extends upward from the handle, and a first outlet passage opening and a second outlet passage opening respectively communicating with the first inlet passage and the second inlet passage are opened in the second pivot joint part.

9. Folding clamshell shower according to claim 1, wherein, the outlet unit comprises: an outlet face cover, a draining mouth, a water diversion plate and an outlet body, the water diversion plate is mounted in the outlet body to define a waterfall water cavity and a shower water cavity;

two first pivot joint parts extend downward from the lower end of the outlet body, a waterfall inlet and a shower inlet are arranged in inner bores of the two first pivot joint parts respectively.

10. Folding clamshell shower according to claim 8, wherein, the two first pivot joint parts are sleeved to the two sides of the second pivot joint part, and a folding and turning pivotal connection relationship is formed by the body and the outlet unit through the coupling of the two pivot joint parts.

11. Folding clamshell shower according to claim 10, wherein, the water diversion body comprises a first water diversion shaft and a second water diversion shaft;

the first inlet is opened on a shaft wall of the first water diversion shaft, and the first water diversion shaft communicates with a first water passing cavity and a first outlet;

the second inlet is opened on a shaft wall of the second water diversion shaft, and the second water diversion shaft communicates with a second water passing cavity and a second outlet;

a bolt is arranged at a back end of the first water diversion shaft, and a screw hole is arranged at a front end of the second water diversion shaft.

12. Folding clamshell shower according to claim 11, wherein, the first water diversion shaft and the second water diversion shaft are screwed to each other to work as a revolving shaft, and are fixedly connected to the two first pivot joint parts.

13. Folding clamshell shower according to claim 11, wherein, the first water diversion shaft is always communicated with a waterfall inlet of an outlet body, the second outlet of the second water diversion shaft is always communicated with a shower inlet of an outlet body.

14. Folding clamshell shower according to claim 11, wherein, the first water diversion shaft and the second water diversion shaft are all formed by two-time injection molding with two kinds of material, and the sealing material is on their surface.

15. Folding clamshell shower according to claim 3, wherein, the water diversion unit also comprises a locating mechanism, a locating groove coupling with the locating mechanism is arranged on the water diversion body, a locating hole coupling with the locating mechanism is opened on the end face of the second pivot joint part.

16. Folding clamshell shower according to claim 5, wherein, the water diversion unit also comprises a locating mechanism, a locating groove coupling with the locating mechanism is arranged on the water diversion body, a locating hole coupling with the locating mechanism is opened on the end face of the second pivot joint part.

17. Folding clamshell shower according to claim 16, wherein, the locating groove is arranged on the first end face of the water diversion body.

18. Folding clamshell shower according to claim 17, wherein, the water diversion body communicates with the water passage through the passage cavity.

19. Folding clamshell shower according to claim 2 further comprising a chuck used for fixedly connecting the outlet unit and the body to the pivot joint site.

20. Folding clamshell shower according to claim 9, wherein, the two first pivot joint part are sleeved to the two sides of the second pivot joint part, and a folding and turning pivotal connection relationship is formed by the body and the outlet unit through the coupling of the two pivot joint parts.

21. Folding clamshell shower according to claim 20, wherein, the water diversion body comprises a first water diversion shaft and a second water diversion shaft;

the first inlet is opened on a shaft wall of the first water diversion shaft, and the first water diversion shaft communicates with a first water passing cavity and a first outlet;

the second inlet is opened on a shaft wall of the second water diversion shaft, and the second water diversion shaft communicates with a second water passing cavity and a second outlet;

a bolt is arranged at a back end of the first water diversion shaft, and a screw hole is arranged at a front end of the second water diversion shaft.

22. Folding clamshell shower according to claim 21, wherein, the first water diversion shaft and the second water diversion shaft are screwed to each other to work as a revolving shaft, and are fixedly connected to the two first pivot joint parts.

23. Folding clamshell shower according to claim 21, wherein, the first water diversion shaft always communicates with the waterfall inlet of the outlet body, the second outlet of the second water diversion shaft always communicates with the shower inlet of the outlet body.

24. Folding clamshell shower according to claim 21, wherein, the first water diversion shaft and the second water diversion shaft are all formed by two-time injection molding with two kinds of material, and the sealing material is on their surface.

* * * * *